US005884573A

United States Patent [19]

Nishikawa et al.

[11] Patent Number: 5,884,573

[45] Date of Patent: Mar. 23, 1999

[54] APPARATUS FOR SEWING A THREAD CHAIN INTO A SEAM BY AN OVERLOCK SEWING MACHINE

[75] Inventors: Masahiko Nishikawa; Toru Yamazaki; Naomasa Iida, all of Osaka, Japan

[73] Assignee: Pegasus Sewing Machine Mfg. Co., Ltd., Osaka, Japan

[21] Appl. No.: 6,865

[22] Filed: Jan. 14, 1998

[30] Foreign Application Priority Data

Jan. 23, 1997 [JP] Japan ..... 9-010110

[51] Int. Cl.[6] ..... D05B 65/06; D05B 1/18; D05B 81/00

[52] U.S. Cl. ..... 112/288; 112/DIG. 1

[58] Field of Search ..... 112/288, 253, 112/DIG. 1, 252, 197, 217

[56] References Cited

U.S. PATENT DOCUMENTS

| | | | |
|---|---|---|---|
| 3,356,054 | 12/1967 | Southwell et al. | 112/197 X |
| 3,490,403 | 1/1970 | Boucraut | 112/288 X |
| 4,038,933 | 8/1977 | Marforio . | |
| 4,903,623 | 2/1990 | Adamsi et al. | 112/253 |
| 5,159,889 | 11/1992 | Price et al. . | |
| 5,203,270 | 4/1993 | Price et al. . | |
| 5,513,588 | 5/1996 | Kojima et al. | 112/197 |
| 5,582,121 | 12/1996 | Nanjo et al. | 112/288 |

*Primary Examiner*—Ismael Izaguirre
*Attorney, Agent, or Firm*—Jones, Tullar & Cooper, P.C.

[57] ABSTRACT

The present invention relates to an apparatus for sewing a thread chain into a seam by an overlock sewing machine, particularly an apparatus for providing a specified length of thread chain remaining in a side of the sewing machine. A cutting device cuts a thread chain formed consecutively with a trailing end of a workpiece at the first operation. In a working face in the vicinity of the cutting device in a fabric feeding side, an air suction nozzle is provided for drawing a separated thread chain remaining in a side of the sewing machine after the first operation of the cutting device. An air injection pipe is provided in a position opposite to an internal bore of a tongue. The air injection pipe blows air toward the internal bore so that the separated thread chain is moved into the internal bore. The separated thread chain is cut by the second operation of the cutting device before or when the separated thread chain drawn into the air suction nozzle is moved into the internal bore by the air from the air injection pipe.

5 Claims, 5 Drawing Sheets

Fabric detecting sensor
Shielded
Unshielded
Sewing machine
Driven
Stopped
Cutting device
Action
Inaction
Second solenoid valve
Open
Closed
First solenoid valve
Open
Closed
C1
T1
T2
T3
T4
T5

APPARATUS FOR SEWING A THREAD CHAIN INTO A SEAM BY AN OVERLOCK SEWING MACHINE

BACKGROUND OF THE INVENTION

1. Field of the Invention

The present invention relates to an apparatus for cutting off a thread chain formed consecutively with the tail end of a seam on a fabric, and for sewing the cut thread chain connected to the needle into the seam of the initial end of the fabric to be sewn next, thereby preventing looseness (ravel) of the thread at the beginning end of sewing.

2. Description of the Invention

Conventionally, such device as disclosed in Japanese Publication No. Sho 56-50599 of examined application (corresponding U.S. Pat. No. 4,038,933) is known for retaining a thread chain in an overlock sewing machine. The conventional device for retaining a thread chain manages a thread chain in the following manner. A thread chain formed consecutively with stitches in a margin of fabric is drawn into a suction tube by air suction in a back side of a needle location, and cut by a cutting device provided in an opening of the tube. Thereafter, a free end of the thread chain remaining in a side of a sewing machine after the cutting operation is drawn into an internal bore of tongue by a suction force of air flowing into the tongue. Then, when a sewing operation is restarted, and a next workpiece is fed in the predetermined direction, the thread chain drawn into the internal bore of tongue is pulled out of the tongue, and sewn into seam formed in the fabric. In such manner, ravel of the thread at the commencement of stitching in a workpiece is prevented without a special bar tacking process.

In such conventional device for retaining a thread chain as described above, a length of thread chain remaining in a side of a sewing machine after the cutting operation is uneven, and it is difficult to draw a free end of the thread chain securely into an internal bore of tongue. Even if a free end of thread chain remaining in a side of a sewing machine is drawn into an internal bore of tongue, it has been a problem that a length of thread chain sewn into seam in successive workpieces is varied, resulting in a product of poor appearance.

In addition, because a length of thread chain sewn into seam in a workpiece depends on a cutting point of a cutting device provided in an opening of a suction tube, it has been a problem that a length of thread chain sewn into seam cannot be changed according to products, and some products may have a poorer appearance.

SUMMARY OF THE INVENTION

It is a primary object of the invention to provide an apparatus for sewing a thread chain into a seam by an overlock sewing machine that is capable of securely drawing a thread chain remaining in a side of the sewing machine after a cutting operation into an internal bore of tongue, and improving an appearance of product by allowing a specified length of thread chain to be sewn into the seam.

It is another object of the invention to provide an apparatus for sewing a thread chain into the seam by an overlock sewing machine that allows a length of thread chain sewn into the seam to be changed arbitrarily according to products for further improving an appearance of the product.

An apparatus according to the invention comprises cutting means positioned in a fabric feeding side of a needle location, air suction means with an air suction port located in a working face in the vicinity of a fabric feeding side of the cutting means and air injection means with an air injecting element facing to a position opposite to an internal bore of tongue. The cutting means cuts a thread chain formed consecutively with a trailing end of a seam in a workpiece. After the thread chain is cut by the cutting means, a separated thread chain remains in a side of the sewing machine. Air suction by the air suction means brings the separated thread chain into a suction port while operation of the sewing machine is paused, and a base end of the separated thread chain is removed from the vicinity of the tongue by air suction of the air suction means. Air injection by the air injection means brings a free end of the separated and suctioned thread chain into the internal bore of tongue.

An apparatus according to the invention is characterized in that the separated thread chain is cut by the cutting means before or when the separated thread chain drawn into the suction port is moved into the internal bore of tongue by the air injection means.

The cutting operation assures a specified length of thread chain to be left ultimately in a side of the sewing machine. The specified length of thread chain is securely drawn into the internal bore of tongue by means of air injection from the opening.

The thread chain in the internal bore is pulled out by advancement of a next workpiece, when the sewing machine is started up after the workpiece is supplied to the working face, and sewn into a seam formed in the workpiece. When the thread chain in the internal bore is pulled out by advancement of the workpiece, no entangled mass of thread is formed by the thread chain at the commencement of stitching.

It is desirable that the air injection and suction means are provided with switching means for switching between connection and disconnection of air supply and control means for controlling an operational timing of the switching means. A cutting point of the thread chain remaining in a side of the sewing machine can be changed by the control means, and a length of the thread chain can be adjusted arbitrarily according to workpieces to be supplied in succession.

It is desirable that the internal bore of tongue is connected with air discharge means for discharging air in the fabric advancing direction through the internal bore when the air suction means is operated. The air discharge means supplements the function of air suction means, and guides the thread chain remaining in a side of the sewing machine in the fabric advancing direction.

The other features and effects of the invention will be better appreciated and understood from the following detailed description of the embodiments taken in conjunction with the drawings.

DESCRIPTION OF THE PREFERRED EMBODIMENT

Figure 1:
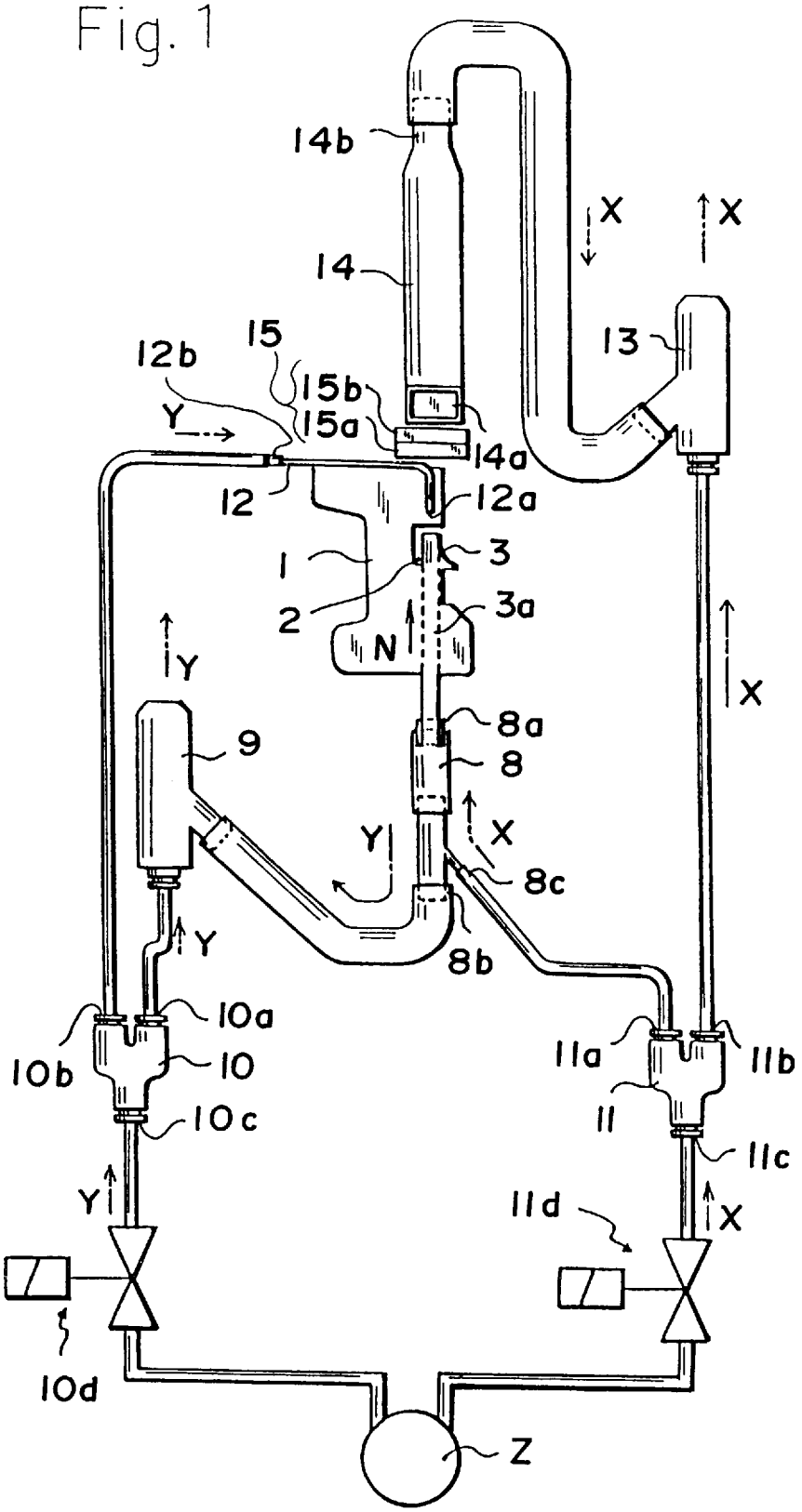
FIG. 1 is a schematic plan view showing an overall structure of an apparatus for sewing a thread chain into a seam by an overlock sewing machine according to an embodiment of the invention.
Figure 2:
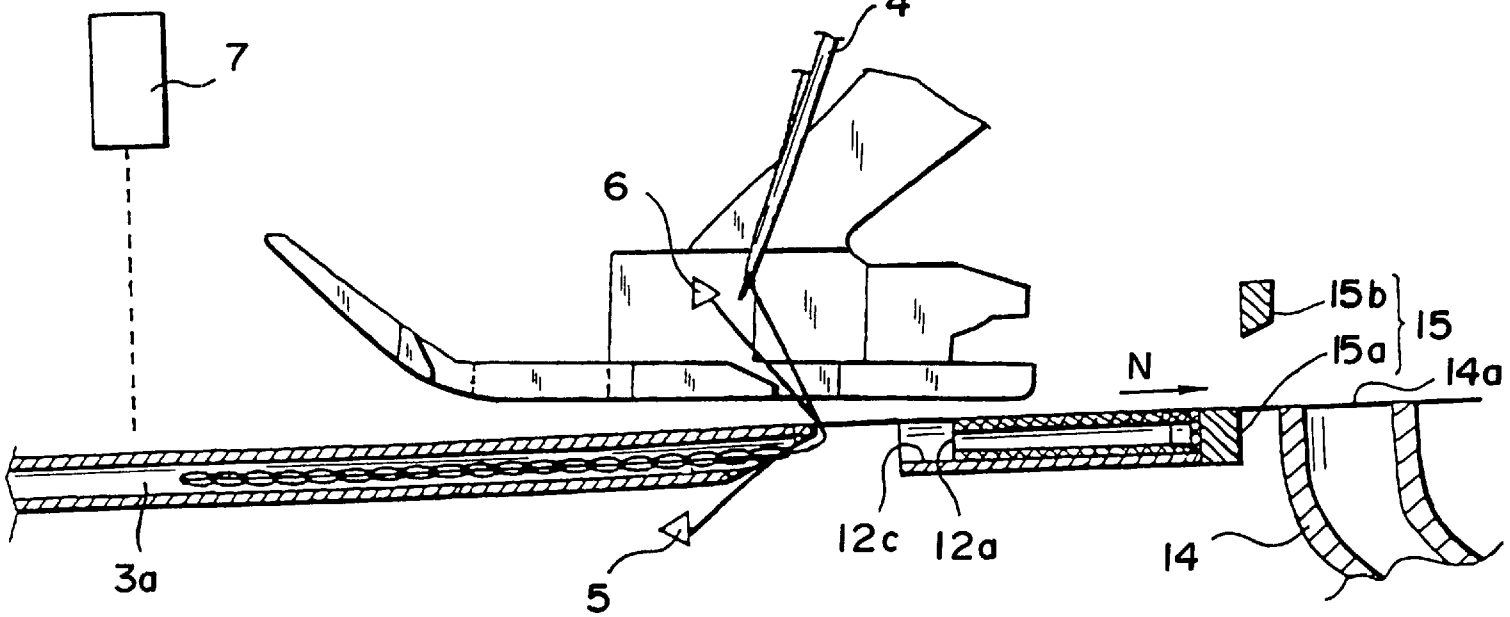
FIG. 2 is a vertical section of a main part of FIG. 1.

In FIG. 1, numeral 1 shows a needle plate of an overlock sewing machine known in the art, and an upper surface thereof forms a part of a working face 1A. A needle location 2 is formed in the needle plate. The needle location 2 vertically passes through the working face 1A. A tongue 3 is integrally formed with the needle plate and extended adjacent to the needle location 2 in the fabric advancing direction N. In FIG. 2, numeral 4 is a needle vertically reciprocating through the needle location 2. Numeral 5 indicates a lower looper provided below the working surface 1A, and reciprocally moved in the direction transverse to the fabric advancing direction N. Numeral 6 indicates an upper looper moving up and down with respect to the needle plate 1. Threads are supplied to the needle 4, the lower looper 5 and the upper looper 6 and overlock stitches are formed by their cooperation in a margin of a workpiece that is passed through the needle location 2. Numeral 7 is a fabric detecting sensor for detecting presence or absence of a workpiece in front of the needle location 2, and is positioned above the working face 1A in front of the needle location 2.

The fabric detecting sensor 7 generates a signal according to a result of detection, and the signal is transmitted to a tensioning device (not shown) known in the art. Thus, an appropriate amount of thread is supplied to the needle 4, the lower looper 5 and the upper looper 6 for forming overlock stitches in a margin of a workpiece and thread chains. When a detection signal indicating absence of a workpiece is generated by the fabric detecting sensor 7, the signal is transmitted to control means described later for operational control of discontinuing operation of the sewing machine.

A internal bore 3*a* is formed from a leading end to a base portion of the tongue 3 in the fabric advancing direction N. An air channel connected to the internal bore 3*a* is extended toward a front side of the needle plate 1, and a front part of the channel is connected with an outlet 8*a* of a joint 8. Out of two inlets formed in the joint 8, one inlet 8*b* is connected to an outlet 10*a* of a first Y-shaped joint 10 through a venturi 9, while the other inlet 8*c* of the joint is connected to an outlet 11*a* of a second Y-shaped joint 11. The other outlet 10*b* of the first joint 10 is connected to an inlet 12*b* of air injection pipe 12 (air injection means). An opening 12*a* forming an outlet of the air injection pipe 12 is located in opposition to the internal bore 3*a*.

The air injection pipe 12 is formed in such manner that it causes no obstruction to a workpiece and thread chain passing over the working face 1A. In other words, an upper part of the air injection pipe 12 is leveled with the working face 1A. The inlet 10*c* of the first joint 10 is connected to a compressor Z by switching means comprising a first solenoid valve 10*d*. A current of air generated by the compressor Z is supplied to the inlet 10*c* of the first joint 10 when a valve element (not shown) of the first solenoid valve 10 is open. The venturi 9 allows the air supplied to the outlet 10*a* from the inlet 10*c* of first joint 10 to be discharged outside. As the air is discharged, an ejecting effect is caused in the venturi 9. As a result, the internal bore 3*a* connected through the joint 8 to the venturi 9 is given an air suction force for drawing a thread chain. An upper part 12*c* of the opening 12*a* in a side of the needle location 2 should be concave so that a thread chain extended from the tongue 3 is stably exposed to the air injected from the opening 12*a*.

An other outlet 11*b* of the second joint 11 is connected to a base portion 14*b* of air suction nozzle 14 (suction means) through a venturi 13. A suction port 14*a* at a leading end of the air suction nozzle 14 is located in a position along an extension of a line connecting the internal bore 3*a* and the opening 12*a*. The suction port 14*a* is provided on a level with the working face 1A. In the vicinity of the suction port 14*a* and an upstream side to the suction port 14*a* in the fabric advancing direction N, a thread chain cutting device 15 known in the art is provided.

The cutting device 15 comprises a fixed blade 15*a* extended in the direction transverse to the workpiece advancing direction N and positioned on a level with the working face 1A, a movable blade 5*b* located above the fixed blade 15*a* and driving means (not shown) for vertically moving the movable blade 15*b*. As the driving means is activated, a tip of the movable blade 15*b* acts cooperatively with the fixed blade 15*a*. Consequently, a thread chain on the fixed blade is cut.

An inlet 11*c* of the second joint 11 is connected with the compressor Z by means of switching means comprising a second solenoid valve 11*d*. A current of air generated by the compressor Z is supplied to the inlet 11*c* of second joint 11 when a valve element (not shown) of the second electromagnetic valve lid is open. The venturi 13 allows the air supplied from the inlet 11*c* of second joint 11 to the other outlet 11*b* to be discharged outside. As the air is discharged, an ejecting effect is caused in the venturi 13. As a result, the suction port 14*a* of suction nozzle 14 connected to the venturi 13 is given an air suction force for drawing a thread chain that is extended from the tongue 3. In the embodiment, although two solenoid valves 10*d*, 11*d* are employed as switching means, it is not limited thereto, and may be, for example, a three-port pneumatic solenoid valve of directional spool type instead.

Figure 3:
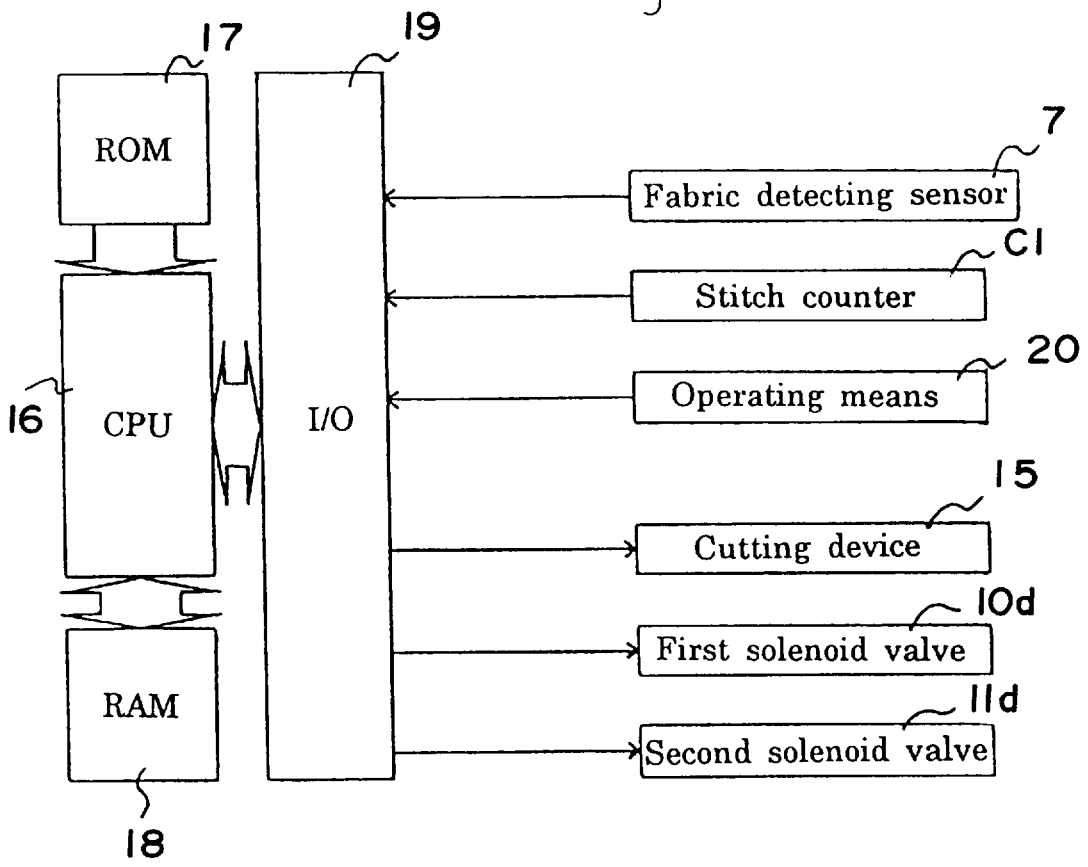
FIG. 3 is a block diagram showing a structure of control means in an embodiment of the invention.

FIG. 3 is a block diagram of a control section in an apparatus for sewing a thread chain into a seam. In the figure, a CPU 16, ROM 17 storing basic operating programs of the cutting means 15 and the valve elements in the solenoid valves 10*d*, 11*d*, RAM 18 storing data for changing operational timings of the valve elements in the solenoid valves 10*d*, 11*d*, I/O 19 and operating means 20 for changing the data stored in the RAM 18. By changing the operational timing in the RAM 18, a thread chain sewn in a seam in a workpiece is changed to a desired length. Numeral C1 is a stitch counter.

Figure 4:
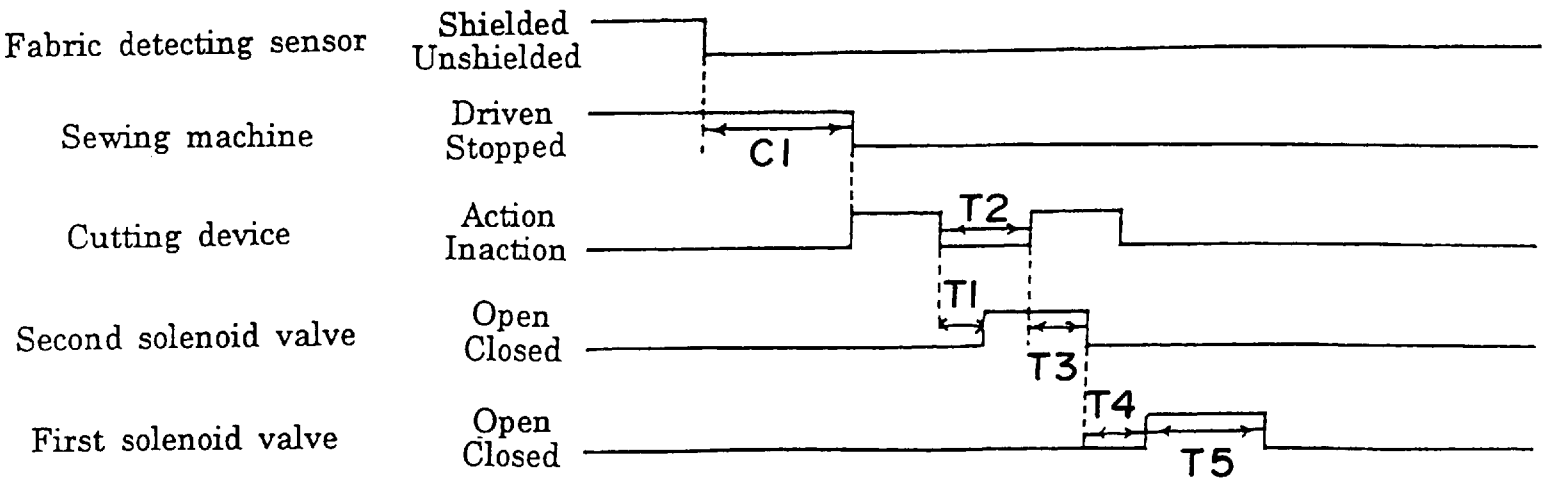
FIG. 4 is a timing chart for explaining operational states of an apparatus according to an embodiment of the invention.

Now, operation of an apparatus of such structure for sewing a thread chain into a seam by an overlock sewing machine is described by referring to a timing chart in FIG. 4.

First, prior to activation of the apparatus for sewing a thread chain into a seam, by placing a workpiece on the working face 1A, and driving the sewing machine, the workpiece is fed in the fabric advancing direction N, and passes the needle location 2. An overlock stitch is formed in a margin of the workpiece that is passed through the needle location 2. Then, as a trailing end of the workpiece is detected by the fabric detecting sensor 7 (corresponding to an unshielded state), a stitch number is counted by the stitch counter C1 known in the art. As soon as the stitch number counted reaches a set value C1, driving of the sewing machine is discontinued. The set value C1 of stitch number is preset to at least such value that the trailing end of workpiece is moved to the back of cutting device 15 as the workpiece is transported by a feeding mechanism of the sewing machine known in the art. As the trailing end of workpiece passes through the needle location 2, a thread chain is created consecutively with a seam formed in a margin of the workpiece. The thread chain led to the tongue from the trailing end of workpiece is cut by discontinuing driving of the sewing machine and activating driving means for the cutting device 15.

When a first predetermined time T1 is elapsed after the operation of cutting the thread chain is completed, the valve element in the second solenoid valve 11*d* is opened, and a current of air generated by the compressor Z is supplied to the inlet 11*c* of second joint 11. The current of air supplied to the inlet 11*c* of second joint 11 is shown by a phantom line X (FIG. 1). A part of the air is supplied from the outlet 11*a* of second joint 11 through the joint 8 into the internal bore 3*a*. The air supplied into the internal bore 3*a* is moved in the workpiece advancing direction N. In such manner, a separated thread chain remaining in a side of the sewing machine is guided to the opening 12*a* of air injection pipe 12 and pulled out of the tongue 3. Then, a balance of the air serves for producing an air suction force in the workpiece advancing direction N in the suction port 14*a* by an ejecting effect in the venturi 13. Accordingly, a free end of the separated thread chain is drawn into the suction port 14*a* located in a fabric feeding side of the cutting device 15 in the working face 1A. After the first operation of cutting the thread chain, when a second predetermined time T2 set to be longer than the first predetermined time T1 is elapsed, the driving means for the cutting device 15 is activated again, and the separated thread chain drawn into the suction port 14*a* is cut. By the second cutting operation, the separated thread chain remaining in a side of the sewing machine comes to be even shorter.

Next, after the second cutting operation of the cutting device 15, when a third predetermined time T3 is elapsed, the valve element in the second solenoid valve 11*d* is closed, and supply of air from the compressor Z to the inlet 11*c* of second joint 11 is discontinued. After a fourth predetermined time T4 is elapsed from the discontinuation until a fifth predetermined time T5 is elapsed, the valve element of first solenoid valve 10*d* is opened, and a current of air generated by the compressor Z is supplied to the inlet 10*c* of first joint 10. The current of air supplied to the inlet 10*c* of first joint 10 is shown by a phantom line Y (FIG. 1). A part of the air is supplied from the outlet 10*b* of first joint 10 to the air injection pipe 12. The air supplied to the air injection pipe 12 is moved from the opening 12*a* in the direction opposite to the workpiece advancing direction N. In such manner, a free end of the short separated thread chain remaining in a side of the sewing machine is drawn into the internal bore 3*a*, as shown in FIG. 2. Then, a balance of the air serves for producing an air suction force in the direction opposite to the workpiece advancing direction N inside the internal bore 3*a* by an ejecting effect in the venturi 9. The air suction force promotes an effect of drawing the short separated thread chain into the internal bore 3*a*.

Figure 5:
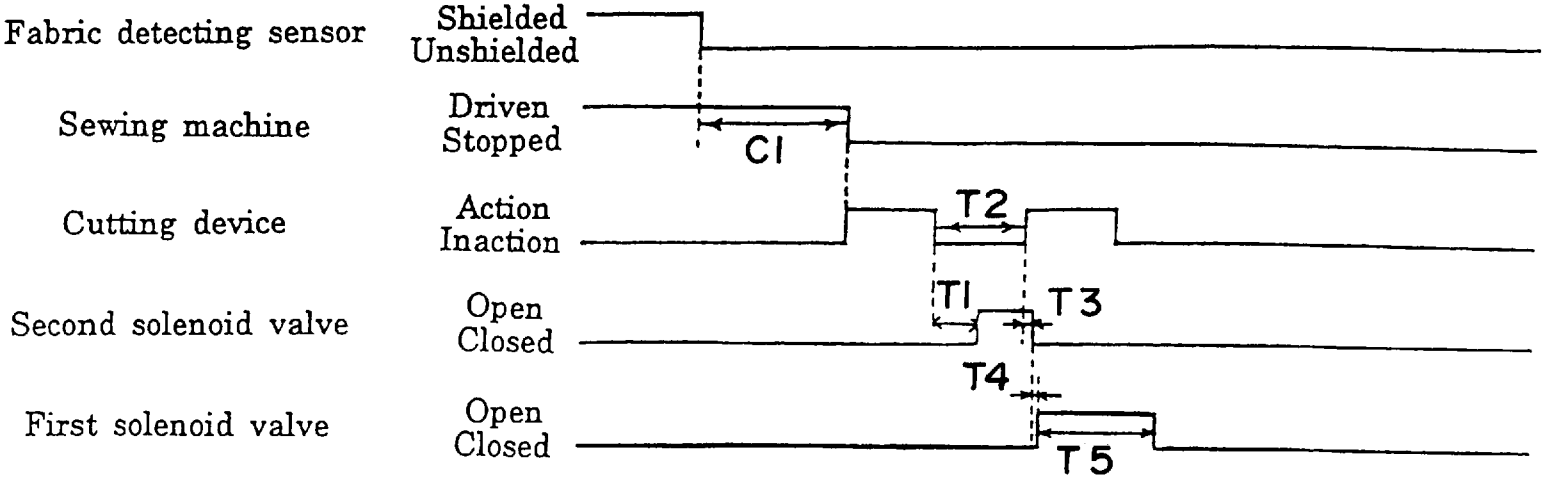
FIG. 5 is a timing chart for explaining the other example of operational states of an apparatus according to an embodiment of the invention.

In operation of the apparatus for sewing a thread chain into a seam by an overlock sewing machine, set values of the third and fourth predetermined times T3, T4 can be changed by means of the operating means 20. For example, as shown in a timing chart of FIG. 5, in the case both predetermined times T3, T4 are set to be short, before the separated thread chain is cut by the cutting device 15 that is reactivated after the second predetermined time T2 is elapsed, the valve element of first solenoid valve 10*d* is opened and the air is supplied to the inlet 10*c* of first joint 10. Accordingly, a length of the separated thread chain drawn into the internal bore 3*a* is increased.

As described above, while the free end of the separated thread chain is retained inside the internal bore 3*a*, a next workpiece is placed on the working face 1A, and the sewing machine is started up. By operation of the sewing machine, an overlock stitch is formed in a margin of the workpiece passing through the needle location 2. In such operation, the separated thread chain drawn into the internal bore 3*a* is pulled out successively, and sewn into the overlock stitch (stitch type identified by reference numeral 504 in Federal Standards in United States) formed in the workpiece.

When an overlock stitch is formed in a margin of a next workpiece, in the case an air suction force in the direction opposite to the workpiece advancing direction N is produced inside the internal bore 3*a*, the separated thread chain pulled out in succession can be maintained in a thin state like a single thread. The separated thread chain maintained in a thin state facilitates insertion to a seam formed in a next workpiece.

What is claimed is:

1. An apparatus for sewing a thread chain into a seam by an overlock sewing machine comprising:

a working surface, a needle plate as a part of the working surface, the needle plate having a needle location and a tongue with an internal bore, and thread chain cutting means provided in a fabric feeding side of the needle location, wherein a thread chain formed consecutively with a trailing end of a workpiece is cut by a first operation of the cutting means, said apparatus comprising:

air suction means for drawing a separated thread chain remaining in a side of said sewing machine after said first operation of cutting means, the air suction means being located in said working surface in the vicinity of a fabric feeding side of said cutting means and air injection means for blowing air toward said internal bore, the air injection means being located in opposition to said internal bore, wherein the separated thread chain is cut by a second operation of said cutting means, while the separated thread chain is drawn by the air suction means after driving of said sewing machine is discontinued, and the separated thread chain ultimately remaining in a side of said sewing machine after the second operation of said cutting means is moved into said internal bore by air injection from the air injection means and the separated thread chain is sewn into a seam formed in a margin of a next workpiece.

2. An apparatus for sewing a thread chain into a seam by an overlock sewing machine of claim 1, wherein said internal bore of the tongue is connected with a second air injection means for injecting air through the internal bore in the workpiece advancing direction when said suction means is in operation.

3. An apparatus for sewing a thread chain into a seam by an overlock sewing machine comprising:

a working surface, a needle plate as a part of the working surface, the needle plate having a needle location and a tongue with an internal bore, and thread chain cutting means provided in a fabric feeding side of the needle location, wherein a thread chain formed consecutively with a trailing end of a workpiece is cut by a first operation of the cutting means, said apparatus comprising:

air suction means for drawing a separated thread chain remaining in a side of said sewing machine after said first operation of cutting means, the air suction means being located in said working surface in the vicinity of a fabric feeding side of said cutting means and air injection means for blowing air toward said internal bore, the air injection means being located in opposition to said internal bore, wherein the separated thread chain is drawn by the air suction means after driving of said sewing machine is discontinued and cut by a second operation of said cutting means as the separated thread chain is moved into said internal bore by air injection from the air injection means, and the separated thread chain ultimately remaining in a side of said sewing machine is sewn into a seam formed in a margin of a next workpiece.

4. An apparatus for sewing a thread chain into a seam by an overlock sewing machine of claim 3, said apparatus further comprising switching means for switching connection and disconnection of air supply to said air suction means and said air injection means, and control means for controlling an operational timing of the switching means.

5. An apparatus for sewing a thread chain into a seam by an overlock sewing machine of claim 3, wherein said internal bore of the tongue is connected with a second air injection means for injecting air through said internal bore in the workpiece advancing direction when said suction means is in operation.

* * * * *

UNITED STATES PATENT AND TRADEMARK OFFICE

CERTIFICATE OF CORRECTION

PATENT NO. : 5,884,573

DATED : March 23, 1999

INVENTOR(S) : Masahiko Nishikawa et al

It is certified that error appears in the above-indentified patent and that said Letters Patent is hereby corrected as shown below:

Claim 1, line 30, between "of" and "cutting" insert --said--.

Claim 3, line 67, between "of" and "cutting" insert --said--.

Signed and Sealed this

Thirty-first Day of August, 1999

*Attest:*

Q. TODD DICKINSON

*Attesting Officer*

*Acting Commissioner of Patents and Trademarks*